US010736476B2

(12) United States Patent
Takayama et al.

(10) Patent No.: US 10,736,476 B2
(45) Date of Patent: Aug. 11, 2020

(54) ELECTRIC VACUUM CLEANER AND HAND DRYER

(71) Applicant: Mitsubishi Electric Corporation, Tokyo (JP)

(72) Inventors: Yuji Takayama, Tokyo (JP); Takashi Yamakawa, Tokyo (JP); Yosuke Shinomoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/095,835

(22) PCT Filed: Jul. 15, 2016

(86) PCT No.: PCT/JP2016/070980
§ 371 (c)(1),
(2) Date: Oct. 23, 2018

(87) PCT Pub. No.: WO2018/011977
PCT Pub. Date: Jan. 18, 2018

(65) Prior Publication Data
US 2019/0167051 A1 Jun. 6, 2019

(51) Int. Cl.
*A47L 5/28* (2006.01)
*A47L 9/28* (2006.01)
(Continued)

(52) U.S. Cl.
CPC ..... *A47L 5/28* (2013.01); *A47K 10/48* (2013.01); *A47L 9/2842* (2013.01);
(Continued)

(58) Field of Classification Search
CPC ..... A47L 5/28; A47L 9/2842; A47L 9/2889; A47L 9/12; A47L 9/16; A47K 10/48; F26B 5/00; F26B 11/00; F26B 11/06; F26B 3/34
(Continued)

(56) References Cited

U.S. PATENT DOCUMENTS 1,691,988 A * 11/1928 Olson ..... A47L 5/36 55/373
3,766,397 A * 10/1973 Rockson ..... A47K 10/48 250/432 R
(Continued)

FOREIGN PATENT DOCUMENTS

CA 3030286 A1 * 1/2018 ..... A47L 11/4041
JP 2002-021794 A 1/2002
(Continued)

OTHER PUBLICATIONS

International Search Report of the International Searching Authority dated Sep. 27, 2016 for the corresponding International application No. PCT/JP2016/070980 (and English translation).
(Continued)

*Primary Examiner* — Stephen M Gravini
(74) *Attorney, Agent, or Firm* — Posz Law Group, PLC

(57) ABSTRACT

A reliable electric vacuum cleaner is provided. An electric vacuum cleaner includes a housing, an electric blower, a battery, and a controller. The housing includes a first chamber, a second chamber, and a handle. The battery is held in the second chamber and supplies electric power for driving the electric blower. The controller controls the electric blower. A first distance from the handle to the battery is shorter than a second distance from the handle to the electric blower.

12 Claims, 8 Drawing Sheets

(51) Int. Cl.
*A47K 10/48* (2006.01)
*A47L 9/12* (2006.01)
*A47L 9/16* (2006.01)

(52) U.S. Cl.
CPC ..... *A47L 9/2884* (2013.01); *A47L 9/2889* (2013.01); *A47L 9/12* (2013.01); *A47L 9/16* (2013.01)

(58) Field of Classification Search
USPC ..... 34/92
See application file for complete search history.

(56) References Cited

U.S. PATENT DOCUMENTS

| | | | | |
|---|---|---|---|---|
| 4,209,875 | A * | 7/1980 | Pugh | A47L 5/24 15/344 |
| 4,383,377 | A * | 5/1983 | Crafton | A47K 10/48 239/136 |
| 4,635,382 | A * | 1/1987 | Bourdeau | A45D 20/06 126/401 |
| 4,890,395 | A * | 1/1990 | Yamac | A45D 20/06 34/96 |
| 5,009,592 | A * | 4/1991 | Roldan | F23D 14/28 432/222 |
| 6,038,786 | A * | 3/2000 | Aisenberg | A47K 10/48 34/202 |
| 8,296,875 | B2 * | 10/2012 | Loberger | E03C 1/057 4/623 |
| 8,444,731 | B2 * | 5/2013 | Gomiciaga-Pereda | A47L 5/24 55/343 |
| 8,490,291 | B2 * | 7/2013 | Churchill | A47K 10/48 222/1 |
| 8,813,383 | B2 * | 8/2014 | Liu | A47K 10/48 15/97.1 |
| 9,093,988 | B2 * | 7/2015 | Yamazaki | H03K 3/012 |
| 9,441,885 | B2 * | 9/2016 | Bayley | A47K 4/00 |
| 9,538,886 | B2 * | 1/2017 | Ros Marin | A47K 10/48 |
| 9,695,546 | B2 * | 7/2017 | Lee | D06F 58/24 |
| 9,743,812 | B2 * | 8/2017 | Courtney | A47K 10/48 |
| 9,826,865 | B2 * | 11/2017 | Maruyama | G01F 23/268 |
| 10,006,192 | B2 * | 6/2018 | Arnott | E03D 9/002 |
| 10,264,931 | B2 * | 4/2019 | Childress | B64D 11/02 |
| 2001/0036409 | A1 | 11/2001 | Murata et al. | |
| 2006/0272170 | A1 * | 12/2006 | Holmes | A61L 9/20 34/275 |
| 2015/0351599 | A1 * | 12/2015 | Park | H02K 1/14 417/423.2 |
| 2016/0066756 | A1 | 3/2016 | Walker et al. | |
| 2018/0177377 | A1 * | 6/2018 | Alpert | A47K 10/48 |
| 2019/0167051 | A1 * | 6/2019 | Takayama | A47L 5/28 |
| 2020/0000300 | A1 * | 1/2020 | Moeller | A47L 7/0095 |

FOREIGN PATENT DOCUMENTS

| | | | | |
|---|---|---|---|---|
| JP | 2004-016541 | A | 1/2004 | |
| JP | 2004-068724 | A | 3/2004 | |
| JP | 2004-283462 | A | 10/2004 | |
| JP | 2008-161257 | A | 7/2008 | |
| JP | 4743668 | B2 | 8/2011 | |
| JP | 4896166 | B | 3/2012 | |
| JP | 2013-220181 | A | 10/2013 | |
| JP | 2015-173673 | A | 10/2015 | |
| JP | 2015-181675 | A | 10/2015 | |
| JP | 2016-055167 | A | 4/2016 | |
| JP | 2016-092920 | A | 5/2016 | |
| JP | WO2018011977 | A1 * | 5/2019 | A47L 9/2884 |
| WO | WO-2018011977 | A1 * | 1/2018 | A47L 9/2842 |
| WO | WO-2018013608 | A1 * | 1/2018 | A47L 11/4091 |

OTHER PUBLICATIONS

Office Action dated Feb. 12, 2020 issued in corresponding JP patent application No. 2018-527356 (and English translation).

* cited by examiner

ELECTRIC VACUUM CLEANER AND HAND DRYER

CROSS REFERENCE TO RELATED APPLICATION

This application is a U.S. national stage application of PCT/JP2016/070980 filed on Jul. 15, 2016, the contents of which are incorporated herein by reference.

TECHNICAL FIELD

The present invention relates to an electric vacuum cleaner and a hand dryer, and particularly to an electric vacuum cleaner and a hand dryer each including an electric blower, a battery, and a controller.

BACKGROUND ART

An electric vacuum cleaner and a hand dryer have conventionally been known as an example of an electrical apparatus including an electric blower. Such an electrical apparatus has been downsized to enhance the portability and operability (see, for example, Japanese Patent Laying-Open No. 2002-21794 (PTL 1)).

CITATION LIST

Patent Literature

PTL 1: Japanese Patent Laying-Open No. 2002-21794

SUMMARY OF INVENTION

Technical Problem

PTL 1 discloses a configuration in which a controller substrate is disposed in the airflow path in an electric blower in order to downsize the electric vacuum cleaner as an electrical apparatus and efficiently cool the controller that controls the electric blower.

In the configuration disclosed in PTL 1, however, if the airflow that comes into contact with the controller substrate contains dust, grit or water droplets, they may adhere to the substrate. If that happens, a short circuit may occur in the circuit on the substrate, resulting in decrease in reliability of the electrical apparatus.

An object of the present invention, which has been made to solve the above problem, is to provide a reliable electric vacuum cleaner and hand dryer.

Solution to Problem

An electric vacuum cleaner according to the present invention includes a housing, an electric blower, a battery, and a controller. The housing includes a first chamber, a second chamber, and a handle. The electric blower is held in the first chamber. The battery is held in the second chamber and supplies electric power for driving the electric blower. The controller is held in the second chamber and controls the electric blower. A first distance from the handle to the battery is shorter than a second distance from the handle to the electric blower.

A hand dryer according to the present invention includes a housing, an electric blower, a battery, and a controller. The housing includes a hand insertion portion, a first chamber, and a second chamber. The electric blower is held in the first chamber. The battery and the controller are held in the second chamber. The battery supplies electric power for driving the electric blower. The controller is held in the second chamber and controls the electric blower. The housing has an intake port and a discharge port. The electric blower sucks air through the intake port and delivers the air to the hand insertion portion through the discharge port.

Advantageous Effects of Invention

According to the present invention, the battery and the controller are held in the second chamber separated from the first chamber where the electric blower is held. The battery and the controller therefore are not directly exposed to the air sucked or delivered by the electric blower. Dust, water and the like contained in the air are thus prevented from adhering to the battery and the controller. This reduces the problem due to the dust, water and the like, such as a short circuit, thus improving the reliability of the electric vacuum cleaner and the hand dryer.

DESCRIPTION OF EMBODIMENTS

Figure 1:
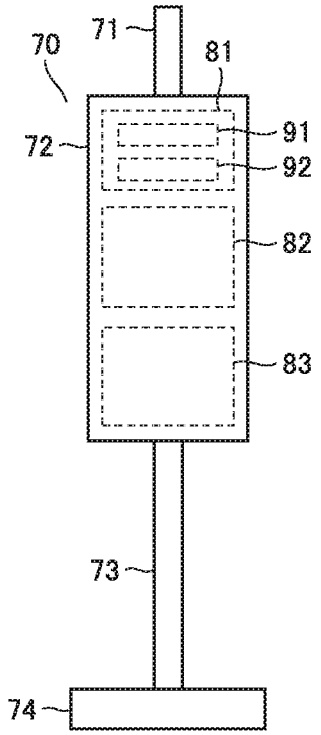
FIG. 1 is a front schematic view of an electrical apparatus according to an embodiment 1 of the present invention.

Embodiments of the present invention are described hereinafter with reference to the drawings. In the drawings, identical or corresponding parts are identically denoted, and the explanation of such parts is not repeated.

Embodiment 1

<Configuration of Electrical Apparatus>

Figure 2:
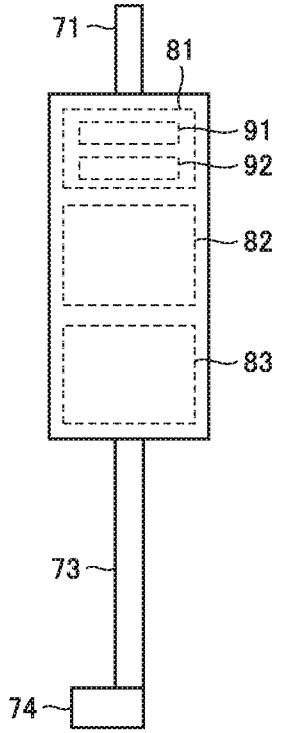
FIG. 2 is a side schematic view of the electrical apparatus shown in FIG. 1.
Figure 3:
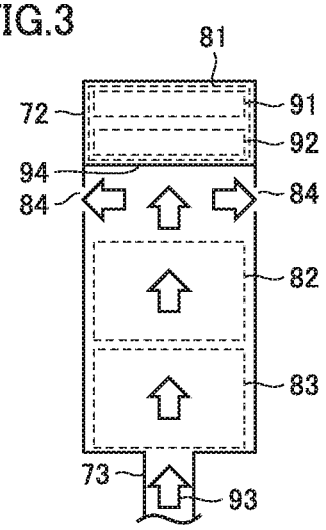
FIG. 3 is a partial schematic view of the electrical apparatus shown in FIG. 1.

An electrical apparatus 70 according to the present embodiment shown in FIG. 1 to FIG. 3 is an electric vacuum cleaner. Specifically, electrical apparatus 70 is a stick electric vacuum cleaner. Electrical apparatus 70 comprises a housing 72, a handle 71 provided on housing 72, an extension wand 73 extending from housing 72, and a suction portion 74 attached to an end of extension wand 73. Housing 72 includes a power supply unit 81, a blower motor unit 82 to drive a blower including an electric blower, and a dust collector unit 83 in order of decreasing distance from extension wand 73. Power supply unit 81 includes a battery 91 and a substrate 92 that forms a controller. A first distance from handle 71 to battery 91 is shorter than a second distance from handle 71 to blower motor unit 82 and shorter than a third distance from handle 71 to substrate 92.

Housing 72 includes a first chamber, a second chamber, and handle 71. Battery 91 supplies substrate 92 with electric power for driving the electric blower. The controller controls blower motor unit 82. In housing 72, a compartment where blower motor unit 82 is held therein is defined as the first chamber. In housing 72, a compartment where battery 91 and substrate 92 are held therein is defined as the second chamber. The second chamber is a compartment independent of the first chamber. The second chamber is preferably an independent room in housing 72. The second chamber may define an enclosed space in housing 72. In housing 72, the second chamber is airtightly separated from the first chamber.

Housing 72 includes a wall 94 (see FIG. 3). Wall 94 airtightly separates the first chamber and the second chamber from each other. From a different viewpoint, wall 94 separates battery 91 and substrate 92 from blower motor unit 82. That is, wall 94 blocks the flow of air from the first chamber to the second chamber. Wall 94 may have any configuration that can block the flow of air. For example, wall 94 may be a plate-like member made of resin or metal.

Specifically, electrical apparatus 70 includes housing 72 with handle 71, suction portion 74 to suck dirt (e.g. dust and grit), and extension wand 73 connecting suction portion 74 and housing 72 to each other. Extension wand 73 is connected to the end of housing 72 opposite to the end where handle 71 is disposed. The connection portion between extension wand 73 and suction portion 74 is bendable. Therefore, while a user is using electrical apparatus 70 by gripping handle 71, the suction surface (e.g. the lower surface) of suction portion 74 is kept in close contact with the floor face regardless of the angles of housing 72 and extension wand 73 relative to the floor face.

In housing 72, power supply unit 81, blower motor unit 82, and dust collector unit 83 are disposed. Power supply unit 81 supplies electric power to blower motor unit 82. Blower motor unit 82 includes an electric blower to generate a suction force. Dust collector unit 83 is a dust collecting compartment where dirt (e.g. dust and grit) sucked through suction portion 74 is collected. Dust collector unit 83 may be externally connected to housing 72. Dust collector unit 83 may have any conventionally well-known configuration. For example, dust collector unit 83 may use the paper filter system or the cyclone system. Power supply unit 81 includes battery 91, and substrate 92 having thereon an inverter circuit that forms the controller. The inverter circuit is used to drive blower motor unit 82.

Housing 72 of electrical apparatus 70 includes power supply unit 81, blower motor unit 82, and dust collector unit 83 arranged in this order in the direction from handle 71 toward extension wand 73. From a different viewpoint, blower motor unit 82 is disposed between power supply unit 81 and dust collector unit 83. In power supply unit 81, the distance from handle 71 to battery 91 is shorter than the distance from handle 71 to substrate 92. As shown in FIG. 3, substrate 92 is adjacent to wall 94 in the second chamber.

As shown in FIG. 3, the air sucked through suction portion 74 (see FIG. 1) is led into housing 72 through extension wand 73, as indicated by arrow 93. The air led into housing 72 passes through dust collector unit 83 and blower motor unit 82 and is discharged to the outside of housing 72 through exhaust ports 84, as indicated by the arrows. Exhaust ports 84, which are openings in side faces of housing 72, are disposed on the blower motor unit 82 side relative to wall 94 in housing 72. Wall 94, which is formed as a partition between substrate 92 and blower motor unit 82, prevents substrate 92 and battery 91 from being exposed to a direct blow of the exhaust air from blower motor unit 82.

The driving of the electric blower of blower motor unit 82 causes air to be sucked into housing 72 as indicated by arrow 93 in FIG. 3, as described above, and the air first passes through dust collector unit 83 which collects dirt. In this dust collector unit 83, dirt is separated from air by the paper filter system or the cyclone system. Fine dust and grit, however, may pass through dust collector unit 83.

If suction portion 74 of electrical apparatus 70 sucks dust not on a floor face but on a wall or ceiling, dust collector unit 83 will incline at an angle different from that for a floor face. Therefore, dust is more likely to pass through dust collector unit 83. In the case of cyclone-system dust collector unit 83 for example, when housing 72 is inclined while electrical apparatus 70 is not in operation, the dirt which has been separated and retained on the cyclone system may pass through dust collector unit 83 by gravity.

The dust and grit that has passed through dust collector unit 83 may accumulate between the terminals of substrate 92 and battery 91. This may cause a short circuit of the power source. Water or the like, if sucked, would also adhere between the terminals, which may cause a short circuit and deterioration due to corrosion. The corrosion of the terminals or the like of substrate 92 and battery 91 may also be caused by air containing much moisture. Therefore, it is preferable that substrate 92 be at a position that is not exposed to the sucked air.

Thus, substrate 92 having the inverter circuit formed thereon and battery 91 are placed not in the flow path of the sucked air. This prevents substrate 92 and battery 91 from coming into contact with air with sucked water and/or air that contains dust and grit. Therefore, substrate 92 and battery 91 are less likely to be short-circuited by water and dust. Further, the deterioration of substrate 92 and battery 91 due to corrosion is reduced. This improves the reliability of the electrical apparatus.

Figure 4:
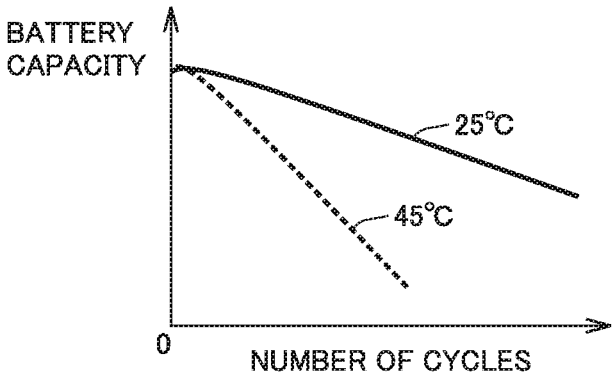
FIG. 4 is a graph showing the relation between the battery capacity and the number of cycles.

FIG. 4 is a graph showing the relation between the battery capacity and the number of cycles. In FIG. 4, the horizontal axis shows the number of cycles of the battery, and the vertical axis shows the battery capacity (also referred to as the electric cell capacity). In the horizontal axis, the origin at the left end is zero and the number of cycles increases toward the right. In the vertical axis, the bottom is the origin and the capacity increases toward the top. In FIG. 4, the solid line indicates the relation between the number of cycles and the capacity of when the external temperature around the battery is 25° C., and the broken line indicates the relation of when the external temperature around the battery is 45° C.

Here the period from when battery 91 is in the full charge state to when battery 91 has been discharged to the discharge cutoff voltage is referred to as one cycle. It is known that a higher external temperature around battery 91 reduces its capacity and shortens its lifetime. As shown in FIG. 4, a comparison of the data under the external temperatures of 25° C. and 45° C. shows that a higher external temperature leads to a larger reduction in battery capacity per cycle. The lifetime of battery 91 thus significantly depends on the external temperature around the battery (also referred to as the battery temperature). Therefore, the heat dissipation characteristics of battery 91 significantly relate to the product lifetime of the electrical apparatus. The temperature of battery 91 may rise to about 50° C. to 60° C. at the maximum when the electrical apparatus is in use.

Figure 5:
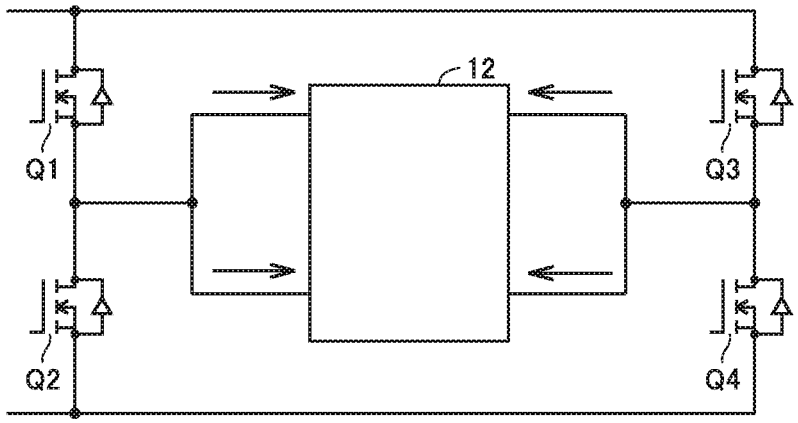
FIG. 5 is a circuit diagram showing an example inverter circuit included in a controller.

Battery 91, a heat-generating source, is relatively large in volume compared with the other heat-generating components that constitute electrical apparatus 70. Therefore, battery 91 takes a longer time to dissipate heat than the other heat-generating components. Examples of heat-generating sources in the inverter circuit formed on substrate 92 included in the controller include a semiconductor device. FIG. 5 is a circuit diagram showing an example inverter circuit included in the controller. The inverter circuit shown in FIG. 5 is for driving a motor 12 of the electric blower included in blower motor unit 82.

A configuration example of a single-phase inverter as shown in FIG. 5 requires four semiconductor devices Q1 to Q4. If each of semiconductor devices Q1 to Q4 is a power semiconductor of a 5 mm×6 mm PQFN package for example, it has a volume of 5 mm×6 mm×1 mm=30 $mm^3$. If battery 91 consists of six cylindrical lithium-ion secondary batteries each having a diameter of 18 mm and a length of 65 mm for example, battery 91 has a volume of about 100000 $mm^3$. Battery 91, which occupies a larger volume than the other heat-generating components, takes a longer time for heat dissipation than the other heat-generating components.

In general, heat transfers from a high temperature portion to a low temperature portion. Therefore, when battery 91 has a high temperature, the heat transfers from battery 91 to a lower temperature portion around battery 91. At this time, the heat transfers to the air around battery 91. The heated air (material) has a reduced specific gravity. The heated air goes up to cause a convection of air around battery 91. Thus, the heat from battery 91 would be more easily dissipated to the outside of electrical apparatus 70 if battery 91 is located at the top as shown in FIG. 1 when electrical apparatus 70 cleans a floor face (which is the most frequent usage mode) or when electrical apparatus 70 is stored. This prolongs the lifetime of battery 91 and improves the reliability of electrical apparatus 70.

There is a possibility that the heat generated from battery 91 may have a bad influence on the other components of electrical apparatus 70. In order to prevent the heat from battery 91 from transferring to the components other than battery 91, it might be possible to provide heat insulating members. Examples of the heat insulating members include fiber heat insulating materials, foamed heat insulating materials, aerogels, and vacuum heat insulating materials. Placing the heat insulating members between battery 91 and the other components disadvantageously increases the manufacturing cost and the mass of electrical apparatus 70. The arrangement as shown in FIG. 1, where heat-sensitive components (e.g. substrate 92 and blower motor unit 82) are not above battery 91, can reduce the bad influence of the heat from battery 91 on the those components.

Figure 6:
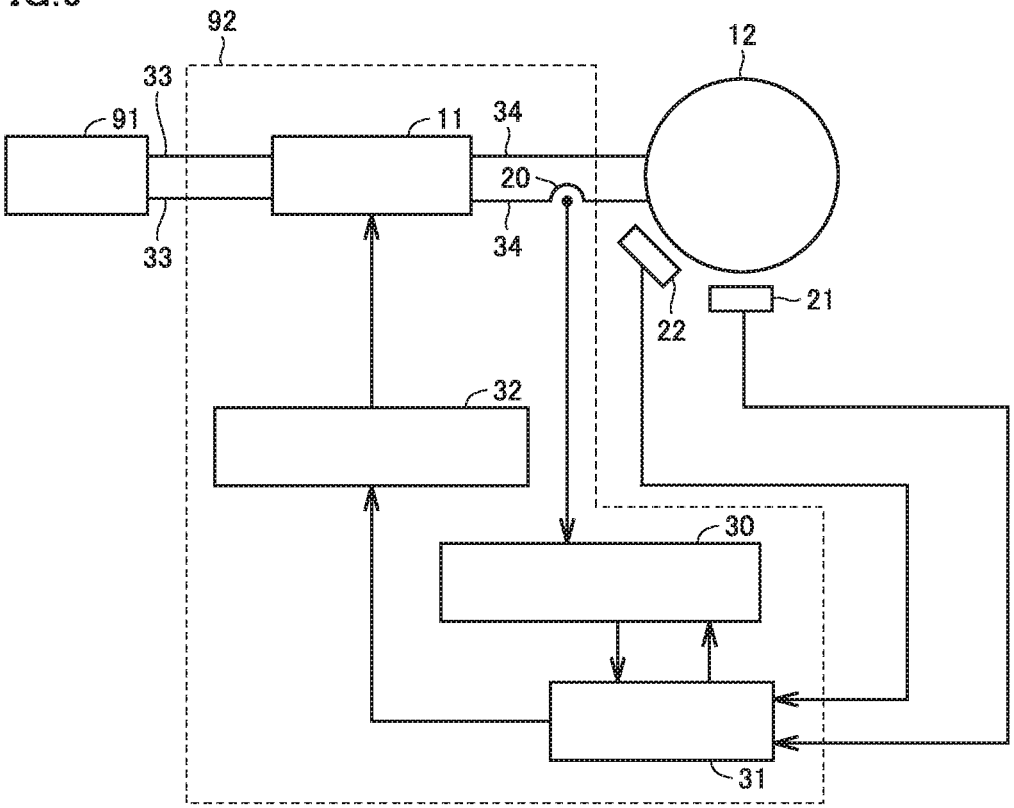
FIG. 6 is a block diagram for explaining the controller of the electrical apparatus shown in FIG. 1.

FIG. 6 is a block diagram for explaining the controller of electrical apparatus 70 shown in FIG. 1. As shown in FIG. 6, in the electrical apparatus, power converter 11 causes motor 12 of blower motor unit 82 (see FIG. 1) to drive, with battery 91 as a power source. The control of power converter 11 is performed by: detectors 21, 22 to detect a rotor rotation position of motor 12; a detector 20 to detect a motor current; a converter 30 to perform analog-digital conversion on the data of the motor current detected by detector 20; a driving signal generator 32 to generate a driving signal for controlling power converter 11; and a processor 31 to control converter 30 and driving signal generator 32. Processor 31 starts up and reads converter 30. Based on a signal read by processor 31, processor 31 causes driving signal generator 32 to generate a driving signal for controlling power converter 11. With the driving signal, the operation of power converter 11 is controlled.

Motor 12 may be controlled by any of commonly used methods. Examples of the control methods include the vector control, the V/F control, and the current control. Motor 12 is controlled by any of the control methods and achieves a rotation speed of about 100000 rpm.

In electrical apparatus 70 as a stick electric vacuum cleaner configured as above, when blower motor unit 82 is driven, a suction force is generated to suck dust, grit and the like through suction portion 74 along with air. The sucked dust and grit accumulates in dust collector unit 83. Since power converter 11 (inverter circuit) allows motor 12 of blower motor unit 82 to rotate at a high speed as described above, the electric blower in blower motor unit 82, even if small in diameter, can send air with high efficiency. Blower motor unit 82 thus can ensure a large volume of air. Therefore, blower motor unit 82, even if relatively small in size, achieves a high suction capability.

The upper limit of the carrier frequency for efficient driving of the inverter circuit is, for example, about 30 kHz. As the rotational frequency of motor 12 of blower motor unit 82 gets closer to the upper limit, the control of motor 12 may become more unstable. In this case, the problem can be avoided by limiting the number of poles of motor 12 to four or less.

In order to improve the operability, there has been a demand for reduction in size and weight of electrical apparatus 70 as a stick electric vacuum cleaner as shown in FIG. 1 to FIG. 3. Reduction in fan diameter of the electric blower mounted on blower motor unit 82, however, makes it difficult to provide an amount of work required for use as a vacuum cleaner. Thus, the fan diameter of the electric blower should be minimized to reduce the size and weight of electrical apparatus 70, and also the rotation speed of the fan should be increased to ensure a required amount of work. The increase in rotation speed of the fan, however, requires motor 12 to generate an increased torque.

As shown in equation (1) below, a torque T generated during rotation of motor 12 is determined by the product of torque constant Kt by motor current Ia.

$$T=Kt\times Ia \tag{1}$$

Thus, in order to increase torque T, the motor may be designed to provide increased torque constant Kt, and/or motor current Ia may be increased. In order to increase torque constant Kt, the number of motor windings of motor 12 may be increased, or a stronger magnet may be used, or the thickness of stacked stator may be increased. Any of such measures, however, disadvantageously leads to increases in manufacturing cost, mass of motor 12, and size of motor 12.

Thus, in order to increase torque T, motor current Ia may be increased. Increased motor current Ia can provide an increased torque while preventing the disadvantageous increase in manufacturing cost in modifying the configuration of motor 12 and the disadvantageous increases in mass and size of motor 12 as described above.

Increasing motor current Ia, however, may increase heat generation at a part where an electric current flows. Thus, a heat-resistant or flame-resistant material may be used as a material adjacent to, for example, motor 12 and power supply unit 81 in electrical apparatus 70, in order to prevent damage to the device due to heat generation when motor current Ia is more than or equal to a certain value. Such a configuration improves the reliability of electrical apparatus 70. By using a material having a high heat transfer rate (e.g. metal) as a material adjacent to motor 12 and power supply unit 81 as described above, the heat-generating components such as power supply unit 81 and battery 91 are improved in heat dissipation capability.

In order to efficiently convert the electric power from battery 91 into the fan output of blower motor unit 82, it is important to reduce the loss at the interconnections between battery 91, the inverter circuit, and motor 12, as well as to enhance the efficiency of each of the inverter circuit, motor 12, and the electric blower. Rotating motor 12 at a high speed as described above will cause a high electric current to flow through the inverter circuit and motor 12 in particular, thus disadvantageously causing the loss at the above-described interconnections. The interconnections as used herein include an interconnection 33 that connects battery 91 and power converter 11 to each other, and an interconnection 34 that connects power converter 11 and motor 12 to each other, as shown in FIG. 6.

In general, an interconnection having a, diameter of 2 mm has an electric resistance (interconnection resistance) of 8 m [Ω/m]. Accordingly, interconnections 33, 34 applied with an electric current of 20 A will have a loss of 3.2 [W/m], for example. Assuming that electrical apparatus 70 has a rated power of about 350 [W], the reduction in efficiency per unit interconnection length is 0.91 [pt/m]. For example, an interconnection having a length of 1 m has efficiency of 99.09%.

In order to reduce the loss at the interconnections, it is preferable to reduce the interconnection resistance by using the shortest and thickest possible interconnections. In the present embodiment, battery 91, substrate 92, and blower motor unit 82 are arranged adjacent to each other in housing 72. This allows shorter interconnections than in the case in which these components are scattered in housing 72. As a result, the loss at the interconnections is reduced, and highly efficient electrical apparatus 70 is achieved.

Motor 12 of blower motor unit 82 includes a rotor with a permanent magnet. This allows high driving efficiency of motor 12 and brings about an energy-saving effect. Detectors 21, 22 used for the control of motor 12 enable the highly accurate inverter control.

Further, using a wide-bandgap semiconductor to form the semiconductor device on the inverter substrate enables a low-loss semiconductor device with a reduced switching loss and conduction loss. The reduction in loss brings about an energy-saving effect, thus enabling a longer-time operation.

<Operation of Electrical Apparatus>

A user uses electrical apparatus 70 shown in FIG. 1 to FIG. 3 by gripping handle 71. When the user turns on a power source switch (not shown), electric power is supplied from battery 91 to the electric blower of blower motor unit 82 through the inverter circuit of substrate 92. This causes the electric blower of blower motor unit 82 to drive, so that air is sucked along with dust or the like through suction portion 74. The air then reaches extension wand 73 and dust collector unit 83. In dust collector unit 83, the dust or the like is separated from the air by any conventionally well-known method. After that, the air passes through blower motor unit 82 to be discharged to the outside through exhaust ports 84 of housing 72 (see FIG. 3). In this way, electrical apparatus 70 sucks dust or the like through suction portion 74 to clean a floor, stairs, a wall, and the like.

<Advantageous Effects of Electrical Apparatus>

In electrical apparatus 70 shown in FIG. 1 to FIG. 3, battery 91 and substrate 92 are held in the second chamber, and blower motor unit 82 including the electric blower is held in the first chamber. Wall 94 is formed to separate the first chamber and the second chamber from each other. Thus, the air sent from the electric blower is prevented from entering the second chamber, and battery 91 and the controller are not exposed to a direct blow of air. Therefore, dust, grit, or water droplets contained in the air would not adhere to battery 91 and substrate 92 of the controller and thus would not cause a short circuit and a malfunction. This provides high reliability to electrical apparatus 70.

From a different viewpoint, electrical apparatus 70 according to embodiment 1 is a stick electric vacuum cleaner and includes battery 91, blower motor unit 82, substrate 92 including an inverter circuit, and dust collector unit 83. From a viewpoint of heat dissipation capability, substrate 92, blower motor unit 82, and dust collector unit 83 are not above battery 91 (heat-generating source) in electrical apparatus 70. This improves the heat dissipation capability of battery 91, which is a heat-generating source and significantly affects the product lifetime. Further, the heat from battery 91 is prevented from transferring to the inverter circuit of substrate 92.

In the above-described electrical apparatus 70, the distance from the electric blower (blower (blower motor unit 82) to battery 91 is longer than the distance from the electric blower (blower motor unit 82) to the controller (substrate 92). That is, battery 91 is disposed on the outer side relative to the controller as seen from the electric blower. Therefore, the controller does not hinder the dissipation of heat from battery 91.

In the above-described electrical apparatus 70, housing 72 includes handle 71 to be gripped by a user. The first distance from handle 71 to battery 91 is shorter than the second distance from handle 71 to the electric blower (blower motor unit 82) and is shorter than the third distance from handle 71 to the controller (substrate 92). In this case, battery 91, which has a relatively large mass, is disposed near handle 71. Therefore, the center of gravity of electrical apparatus 70 is closer to handle 71 than in the case in which battery 91 is remote from handle 71. This improves the operability of electrical apparatus 70 when a user carries electrical apparatus 70 by handle 71.

In the above-described electrical apparatus 70, battery 91 may be above the electric blower and the controller (substrate 92) during use of the electrical apparatus. From a different viewpoint, in the above-described electrical apparatus 70, the electric blower and the controller (substrate 92) are not above battery 91 during use of electrical apparatus 70.

Since the electric blower and the controller (substrate 92) are not above battery 91, housing 72 or a heat dissipation structure (e.g. a heat sink) for battery 91 can be disposed right above battery 91. The electric blower and the controller (substrate 92) do not block a flow of air moving (circulating) upward to above battery 91 due to the heat from battery 91. That is, the electric blower and the controller do not hinder the dissipation of heat from battery 91.

In the above-described electrical apparatus 70, the electric blower may include a radial impeller and an electric motor (motor 12). Motor 12 causes the radial impeller to rotate. Motor 12 includes a rotor and a stator surrounding the rotor. The rotor may include a permanent magnet. In this case, motor 12 is smaller in size and allows higher heat dissipation capability than in the case in which the permanent magnet is on the stator of motor 12.

In the above-described electrical apparatus 70, the controller (substrate 92) may include semiconductor devices Q1 to Q4 each including a wide-bandgap semiconductor. In this case, semiconductor devices Q1 to Q4 in the circuit (for example, the inverter circuit) included in the controller have a lower loss than with conventional silicon-based semiconductor devices. Thus, the energy efficiency of electrical apparatus 70 is improved.

In the above-described electrical apparatus 70, the wide-bandgap semiconductor may be one selected from the group consisting of silicon carbide (SiC), gallium nitride (GaN), and diamond.

Embodiment 2

Figure 7:
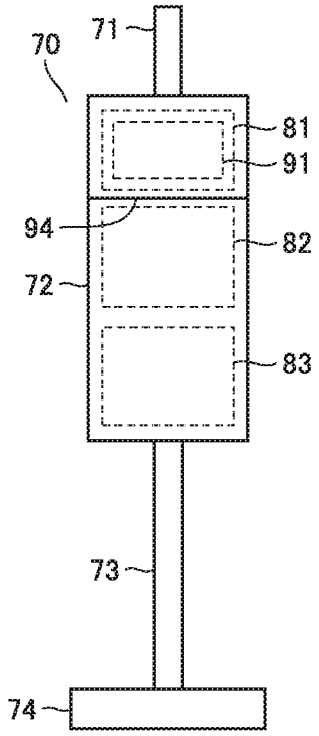
FIG. 7 is a front schematic view of an electrical apparatus according to an embodiment 2 of the present invention.
Figure 8:
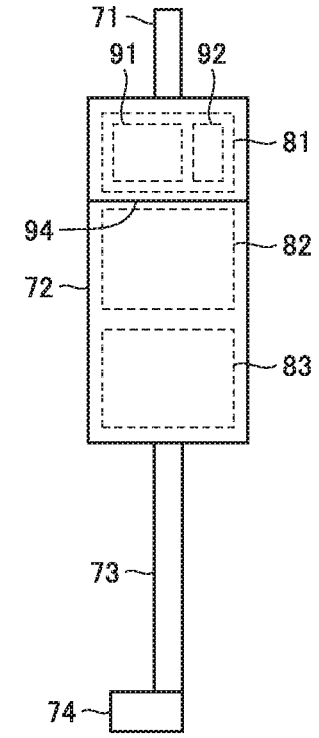
FIG. 8 is a side schematic view of the electrical apparatus shown in FIG. 7.

Electrical apparatus 70 according to the present embodiment shown in FIG. 7 and FIG. 8 is an electric vacuum cleaner. Although electrical apparatus 70 shown in FIG. 7 and FIG. 8 is basically similar in configuration to electrical apparatus 70 shown in FIG. 1 to FIG. 6, the former is different from the latter in the configuration of power supply unit 81. Specifically, electrical apparatus 70 shown in FIG. 7 and FIG. 8 is different from electrical apparatus 70 shown in FIG. 1 to FIG. 3 in that battery 91 and substrate 92 are horizontally arranged in power supply unit 81. From a different viewpoint, in electrical apparatus 70 shown in FIG. 7 and FIG. 8, battery 91 and substrate 92 do not coincide in position with each other in the direction from blower motor unit 82 to power supply unit 81 but are aligned in the direction orthogonal to the direction from blower motor unit 82 to power supply unit 81. At least a part of battery 91 coincides in position with handle 71 in the direction from blower motor unit 82 to power supply unit 81. From a different viewpoint, substrate 92 does not coincide in position with handle 71 in the direction.

Such a configuration, where substrate 92 etc. is not above battery 91, can bring about the same advantageous effects as those of electrical apparatus 70 shown in FIG. 1 to FIG. 3. That is, considering that the heat generated from battery 91 largely transfers upward, the same advantageous effects as those of electrical apparatus 70 shown in FIG. 1 to FIG. 3 can be obtained if a component, such as substrate 92, is placed at a location other than the space above batter 91. The positions of battery 91 and substrate 92 may be switched in electrical apparatus 70 shown in FIG. 7 and FIG. 8.

Embodiment 3

Figure 9:
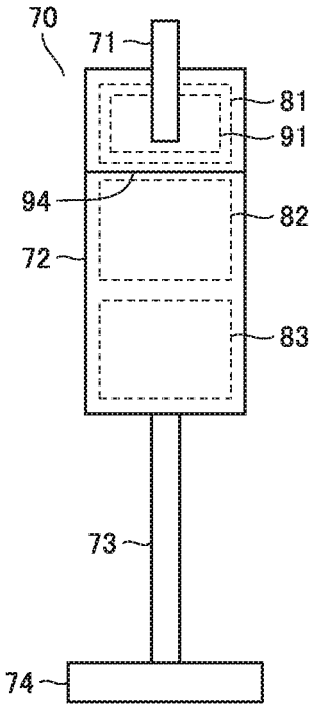
FIG. 9 is a front schematic view of an electrical apparatus according to an embodiment 3 of the present invention.
Figure 10:
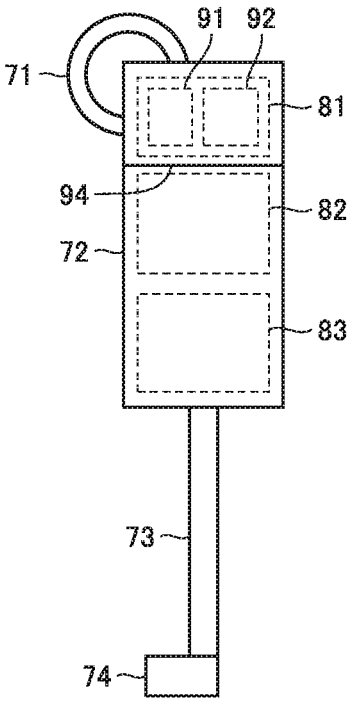
FIG. 10 is a side schematic view of the electrical apparatus shown in FIG. 9.
Figure 11:
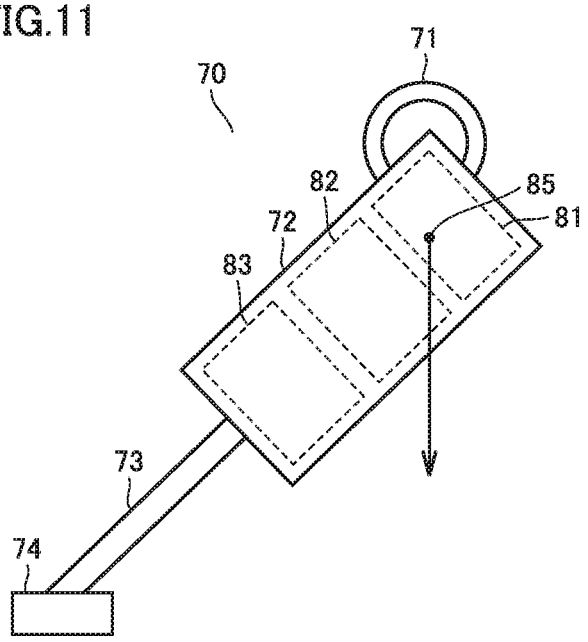
FIG. 11 is a schematic view of the electrical apparatus shown in FIG. 9 in use.

Electrical apparatus 70 according to the present embodiment shown in FIG. 9 to FIG. 11 is an electric vacuum cleaner. Although electrical apparatus 70 shown in FIG. 9 to FIG. 11 is basically similar in configuration to electrical apparatus 70 shown in FIG. 7 and FIG. 8, the former is different from the latter in the position and shape of handle 71. Specifically, in electrical apparatus 70 shown in FIG. 9 to FIG. 11, handle 71 has an annular shape extending from a side face of housing 72 to the top face of housing 72. Electrical apparatus 70 having such a configuration can bring about the same advantageous effects as those of electrical apparatus 70 shown in FIG. 7 and FIG. 8.

The position of handle 71 is determined as follows. Specifically, when electrical apparatus 70 cleans a floor face (which is the most frequent usage mode), a suitable body angle as shown in FIG. 11 is determined. In this state, handle 71 is positioned to be vertically above the center of gravity 85. With the configuration in which handle 71 to be gripped by a user is positioned just above the center of gravity 85 of the body, the same advantageous effects as those of the above-described embodiments 1, 2 are obtained, and the operability of electrical apparatus 70 is improved.

In electrical apparatus 70 of embodiments 2 and 3, as to the position of battery 91, the first distance from handle 71 to battery 91 is shorter than the second distance from handle 71 to substrate 92. In this case, battery 91, which has a relatively large mass, is disposed near handle 71. Therefore, the center of gravity of electrical apparatus 70 is closer to handle 71 than in the case in which battery 91 is remote from handle 71. This improves the operability of electrical apparatus 70 when a user carries electrical apparatus 70 by handle 71.

Embodiment 4

<Configuration of Electrical Apparatus>

Figure 12:
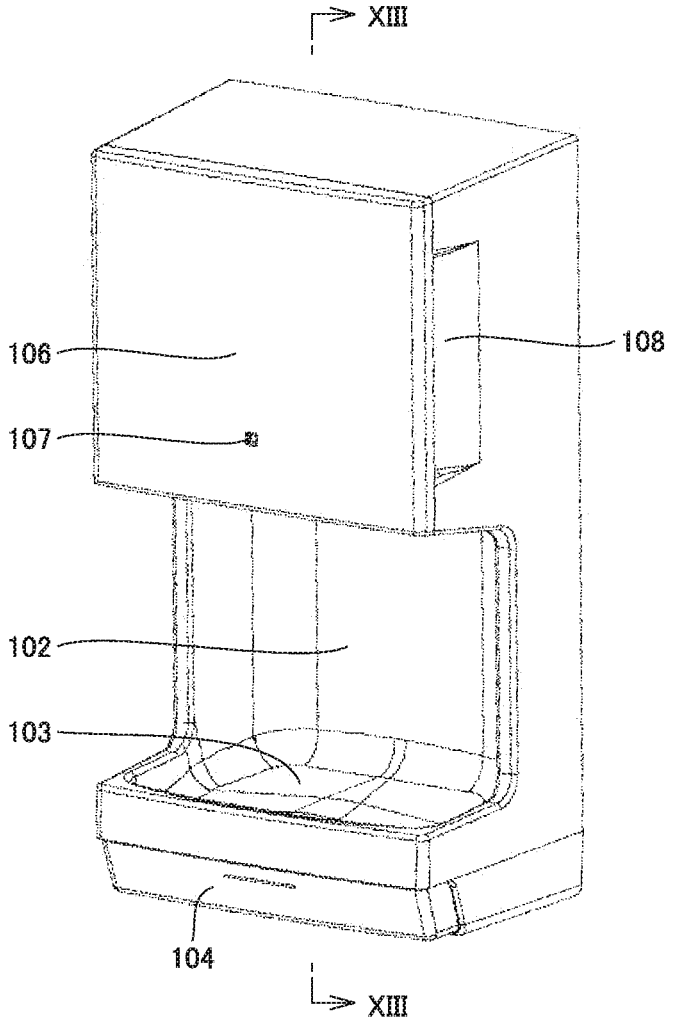
FIG. 12 is a front schematic view of an electrical apparatus according to an embodiment 4 of the present invention.
Figure 13:
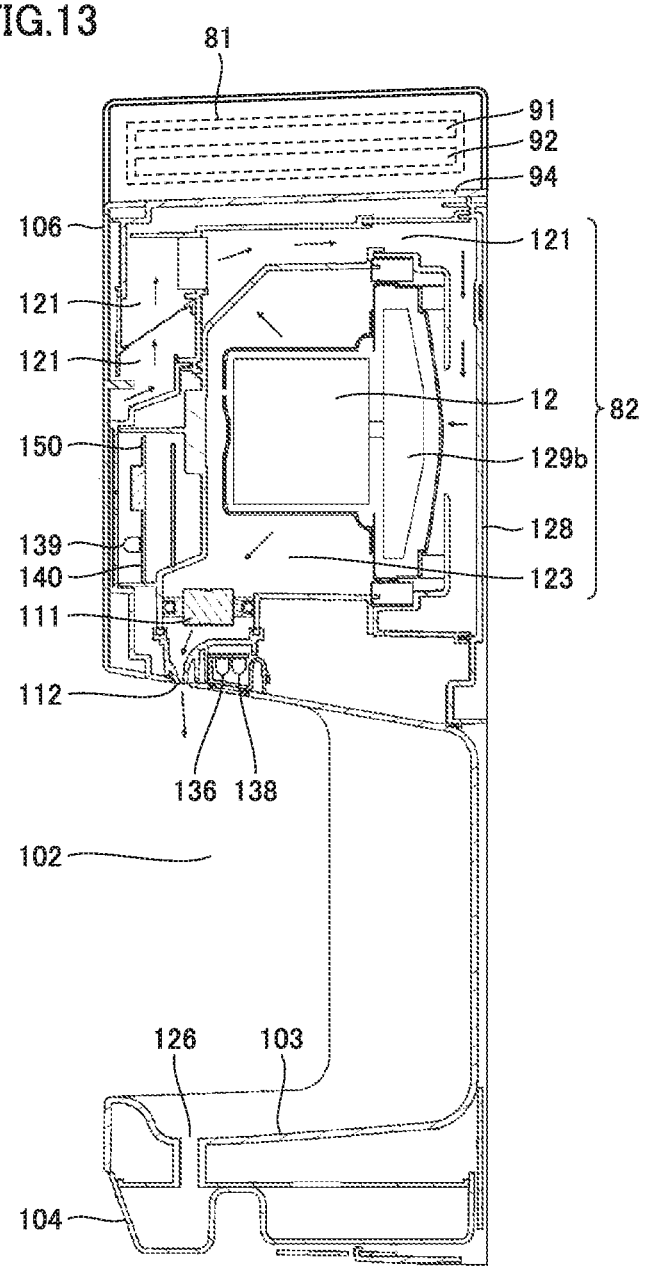
FIG. 13 is a cross-sectional schematic view along the segment XIII-XIII in FIG. 12.

Electrical apparatus 70 shown in FIG. 12 and FIG. 13 is a hand dryer. The hand dryer includes a casing 106, a hand insertion portion 102, a water receiving portion 103, a drain container 104, power supply unit 81 including battery 91 and substrate 92, a translucent window 107, and an intake port 108. In the hand dryer, casing 106 includes an electric blower. In the hand dryer, water on hands inserted in hand insertion portion 102 above water receiving portion 103 is blown off by the air sent from the electric blower, and the water is led from water receiving portion 103 to drain container 104 to be collected therein.

In the present embodiment, similarly to embodiments 1 to 3, battery 91 included in power supply unit 81 is disposed above substrate 92 that includes the inverter circuit, and above blower motor unit 82 that includes the electric blower. Casing 106 as a housing includes a first chamber where the above blower motor unit 82 is held and a second chamber where the above power supply unit 81 is held. Casing 106 includes wall 94 to separate blower motor unit 82 and power supply unit 81 from each other.

As shown in FIG. 12 and FIG. 13, casing 106, which forms an outer shell of the hand dryer, has a hand insertion opening at the front. Casing 106 includes hand insertion portion 102 as a working space continuous with the hand insertion opening. A user can insert the hands in hand insertion portion 102. Hand insertion portion 102 is formed at the lower front of casing 106 as a recess in the form of an open sink with its front and both sides open. Water receiving portion 103 is disposed to form the lower part of hand insertion portion 102. As shown in FIG. 13, the bottom of water receiving portion 103 is inclined downward toward the front and is provided with a discharge outlet 126 at the lower end of the inclination. Below water receiving portion 103, drain container 104 is removably provided to collect water dropped from discharge outlet 126. At the upper part of hand insertion portion 102, a nozzle 112 is provided to jet high-speed air downward to hand insertion portion 102.

In the box-shaped space above hand insertion portion 102 defined by casing 106 and a base 128 that forms the rear-side outer shell of the hand dryer, an electric blower is provided. The electric blower includes motor 12 which is an AC commutator motor, and a turbofan **129*b* which is a rotating impeller fixed to the rotation shaft of motor 12. The electric blower is driven by the electric power from the battery included in the above-described power supply unit 81. The box-shaped space includes an intake air path 121 that communicates the intake side of the electric blower with intake port 108 in a side face of casing 106, and an exhaust air path 123 that communicates the exhaust side of the electric blower with nozzle 112**.

A heater 111 is provided near and upstream of nozzle 112, in the middle of exhaust air path 123. Heater 111 generates warm air by heating the air sent from the electric blower. A circuit board, which includes a hand detector 136 and an illumination LED 138, is provided on the rear side relative to nozzle 112 in casing 106. Hand detector 136 emits light to and receives light from hand insertion portion 102, and illumination LED 138 emits light to hand insertion portion 102. Hand detector 136 detects a hand in hand insertion portion 102 through a translucent window provided on the top face of hand insertion portion 102 at a part of casing 106, the translucent window allowing transmission of visible light and infrared radiation. When a hand inserted in hand insertion portion 102 is detected, illumination LED 138 as an illuminating means illuminates hand insertion portion 102.

Casing 106 includes, near its front face, a circuit board 140 provided with: a control circuit 150; a power indicator LED 139 as a power indicating means that lights up to indicate that the apparatus has been powered on and is on standby; and a changing-over switch as a switching means for switching ON/OFF of illumination LED 138 and power indicator LED 139 independently. Power indicator LED 139 emits light frontward, and the operation panel of the changing-over switch faces the front. Casing 106 has a translucent window 107 so that the light of power indicator LED 139 is visible from the outside of casing 106.

The configuration of the electrical apparatus as a hand dryer as described above is summarized as follows. The hand dryer includes a housing (casing 106), an electric blower included in blower motor unit 82, battery 91, and a controller that includes substrate 92 having a control circuit. Casing 106 includes hand insertion portion 102 which is an opening to receive a hand of a user, a first chamber (which is a compartment located between wall 94 and hand insertion portion 102 in casing 106), and a second chamber (which is a compartment located above wall 94 in casing 106).

The electric blower is held in the first chamber. Battery 91 and the controller are held in the second chamber. Battery 91 supplies electric power for driving the electric blower. The controller is held in the second chamber and controls blower motor unit 82. Casing 106 has intake port 108 and a discharge port (nozzle 112). The electric blower sucks air through intake port 108 and delivers air to hand insertion portion 102 through nozzle 112. Battery 91 may be disposed above hand insertion portion 102. The controller (substrate 92) may also be disposed above hand insertion portion 102.

In the above-described hand dryer, the electric blower included in blower motor unit 82 includes a radial impeller (turbofan 129*b*) and an electric motor (motor 12) to rotate the radial impeller. Motor 12 includes a rotor and a stator surrounding the rotor. The rotor includes a permanent magnet. The controller including substrate 92 includes a semiconductor device including a wide-bandgap semiconductor. The wide-bandgap semiconductor is one selected from the group consisting of silicon carbide, gallium nitride, and diamond. The second chamber is airtightly separated from the first chamber. Specifically, the second chamber is airtightly separated from the first chamber by wall 94. Wall 94 may have any configuration that can block the flow of air, as in the case of wall 94 in the electrical apparatus shown in embodiments 1 to 3.

<Operation of Electrical Apparatus>

The operation of the electrical apparatus when it is used for drying hands will now be described. When the power source switch of the electrical apparatus as a hand dryer is turned on, power is supplied from battery 91 to the control circuit including substrate 92 so that the electrical apparatus is ready for hand drying (hereinafter referred to as a standby state). Upon supply of power to the control circuit, illumination LED 138 lights on if the changing-over switch for illumination LED 138 is at the ON position, and power indicator LED 139 lights on if the changing-over switch for power indicator LED 139 is at the ON position. When a user inserts wet hands through the hand insertion opening into hand insertion portion 102 to around the wrists, hand detector 136 detects the inserted hands. This causes the control circuit to operate the electric blower.

When the electric blower starts operating, the air on the outside of the hand dryer is sucked through intake ports 108 in both side faces of casing 106. The air sucked through intake ports 108 passes through intake air path 121 and through the space above the electric blower to the rear side. The air then moves downward and is sucked from the intake side of the electric blower. The electric blower converts the air sucked from the intake side into high-pressure air and exhausts it from the exhaust side. The exhausted high-pressure air passes through exhaust air path 123 and is converted at nozzle 112 into a high-speed airflow having high kinetic energy. The high-speed airflow jets downward into hand insertion portion 102. The high-speed airflow jetting from nozzle 112 blows against the wet hands in hand insertion portion 102 and blows off the water from the surface of the hands. The hands are thus dried. When a heater switch (not shown) provided in casing 106 is ON, heater 111 is turned on to heat the high-pressure air passing through exhaust air path 123. Thus, warm air jets from nozzle 112 and a user can feel comfortable during use in winter, for example.

When the hands are removed from hand insertion portion 102 after completing the hand drying, hand detector 136 detects the removal of the hands and the electric blower stops. The water droplets blown off the hands flow down to discharge outlet 126 in water receiving portion 103 which inclines forward, and are collected in drain container 104 through discharge outlet 126.

<Advantageous Effects of Electrical Apparatus>

In the above-described electrical apparatus (hand dryer), the outside air sucked through intake port 108 to the electric blower and delivered through the discharge port (nozzle 112) does not come into direct contact with battery 91 and the controller (substrate 92). Therefore, dust, grit, water and the like contained in the outside air do not adhere to battery 91 and the controller and thus do not cause a failure in the electrical apparatus. This improves the reliability of the electrical apparatus.

A widespread hand dryer is supplied with electric power from an electrical outlet of AC 100 V or AC 200 V, for example. It is, however, conceivable that a portable battery-operated hand dryer that can be installed easily anywhere will be widespread in the future, such as the electrical apparatus shown in the present embodiment.

As in embodiments 1 to 3, for a battery-operated hand dryer shown in FIG. 12 and FIG. 13 with a battery as a power source, the battery lifetime significantly affects the product lifetime. Therefore, the dissipation of heat from a battery should be regarded important as in the case of the stick electric vacuum cleaner shown in embodiments 1 to 3 described above. Therefore, the configuration as shown in FIG. 13, where battery 91 is disposed above substrate 92

(including the inverter circuit) and blower motor unit 82, allows the product to have a higher heat dissipation capability. Thus, the quality of product is improved.

In the case of a hand dryer, the air that enters casing 106 may contain more water than in the case of a stick electric vacuum cleaner. Thus, a first chamber and a second chamber that are airtightly separated from each other by wall 94 are formed in casing 106, where the second chamber includes battery 91 and the first chamber includes the electric blower, for example. With the configuration where substrate 92 and battery 91 are not in the path of air blown by the electric blower, a short circuit of the power source is prevented. Thus, a reliable hand dryer as the electrical apparatus is provided.

Although the above-described embodiments show a stick electric vacuum cleaner and a hand dryer, the present invention is applicable to any electrical apparatus product equipped with battery 91 and an electric blower. For example, a canister electric vacuum cleaner may be employed as the electrical apparatus.

The embodiments of the present invention described above may be modified in various ways. The scope of the present invention is not limited to the above-described embodiments. The scope of the present invention is defined by the terms of the claims and is intended to include any modification within the meaning and the scope equivalent to the terms of the claims.

INDUSTRIAL APPLICABILITY

The present invention is advantageously applicable, in particular, to a handy vacuum cleaner and a hand dryer equipped with a battery and an electric blower.

REFERENCE SIGNS LIST

11: power converter; 12: motor; 20, 21: detector; 30: converter; 31: processor; 32: driving signal generator; 33, 34: interconnection; 70: electrical apparatus; 71: handle; 72: housing; 73: extension wand; 74: suction portion; 81: power supply unit; 82: blower motor unit; 83: dust collector unit; 84: exhaust port; 85: the center of gravity; 91: battery; 92: substrate; 93: arrow; 94: wall; 102: hand insertion portion; 103: water receiving portion; 104: drain container; 106: casing; 107: translucent window; 108: intake port; 111: heater; 112: nozzle; 121: intake air path; 123: exhaust air path; 126: discharge outlet; 128: base; 129*b*: turbofan; 136: hand detector; 138: illumination LED; 139: power indicator LED; 140: circuit board; 150: control circuit

The invention claimed is:

1. An electric vacuum cleaner comprising:

a housing including a first chamber, a second chamber, and a handle;

a suction portion;

an extension wand connecting the suction portion and the housing;

an electric blower held in the first chamber, the electric blower including a radial impeller and an electric motor to rotate the radial impeller;

a battery held in the second chamber to supply electric power for driving the electric blower; and a controller held in the second chamber to control the electric blower, wherein an exhaust port is formed in a side face of the housing, air drawn through the suction portion is discharged to outside of the housing through the exhaust port, and a first distance from the handle to the battery is shorter than a second distance from the handle to the electric blower.

2. The electric vacuum cleaner according to claim 1, wherein, during use of the electric vacuum cleaner, the battery is above the electric blower and the controller.

3. The electric vacuum cleaner according to claim 1, wherein the electric motor includes a rotor and a stator surrounding the rotor, and the rotor includes a permanent magnet.

4. The electric vacuum cleaner according to claim 1, wherein the controller includes a semiconductor device including a wide-bandgap semiconductor.

5. The electric vacuum cleaner according to claim 4 wherein the wide-bandgap semiconductor is one selected from the group consisting of silicon carbide, gallium nitride, and diamond.

6. The electric vacuum cleaner according to claim 1, further comprising:

a dust collector connected to the housing, wherein a suction portion is connected to the dust collector and draws outside air, and the dust collector collects dust contained in the outside air drawn through the suction portion by driving of the electric blower.

7. The electric vacuum cleaner according to claim 1, wherein the second chamber is airtightly separated from the first chamber.

8. A hand dryer comprising:

a housing including a hand insertion portion, a first chamber, and a second chamber;

an electric blower held in the first chamber;

a battery held in the second chamber to supply electric power for driving the electric blower; and a controller held in the second chamber to control the electric blower, wherein the housing has an intake port and a discharge port, the electric blower draws air through the intake port and delivers the air to the hand insertion portion through the discharge port, and the first chamber is located above the hand insertion portion and the second chamber is located above the first chamber in the housing.

9. The hand dryer according to claim 8, wherein the electric blower includes a radial impeller and an electric motor to rotate the radial impeller, the electric motor includes a rotor and a stator surrounding the rotor, and the rotor includes a permanent magnet.

10. The hand dryer according to claim 8, wherein the controller includes a semiconductor device including a wide-bandgap semiconductor.

11. The hand dryer according to claim 10, wherein the wide-bandgap semiconductor is one selected from the group consisting of silicon carbide, gallium nitride, and diamond.

12. The hand dryer according to claim 8, wherein the second chamber is airtightly separated from the first chamber.

* * * * *